United States Patent [19]

Wagner et al.

[11] Patent Number: 4,681,479

[45] Date of Patent: Jul. 21, 1987

[54] PORTABLE TRAFFIC CONTROL GATE

[76] Inventors: Richard H. Wagner, 1679 Elm St.; George J. Wagner, 5498 Windflower Dr., both of Livermore, Calif. 94550

[21] Appl. No.: 821,480

[22] Filed: Jan. 22, 1986

[51] Int. Cl.[4] ..... E01F 13/00

[52] U.S. Cl. ..... 404/6; 49/49

[58] Field of Search ..... 404/6, 9; 14/53; 49/9, 49/49, 35, 334; 246/127, 293; 340/114 B, 130; 116/63 P; 248/500, 503; 403/4; 16/270

[56] References Cited

U.S. PATENT DOCUMENTS

| | | | |
|---|---|---|---|
| 390,618 | 10/1888 | Riding | 49/338 |
| 485,894 | 11/1892 | Smith | 49/226 |
| 1,520,392 | 12/1924 | Dupcza | 246/293 X |
| 1,604,014 | 10/1926 | Billups | 49/9 X |
| 1,899,496 | 2/1933 | Day | 49/334 |
| 3,926,529 | 12/1975 | Brooks | 16/270 X |
| 4,318,079 | 3/1982 | Dickinson | 340/127 |
| 4,457,105 | 7/1984 | Danin | 49/49 |

FOREIGN PATENT DOCUMENTS

| | | | |
|---|---|---|---|
| 2815767 | 10/1979 | Fed. Rep. of Germany | 404/9 |

*Primary Examiner*—Stephen J. Novosad
*Assistant Examiner*—Matthew Smith
*Attorney, Agent, or Firm*—Thomas Schneck

[57] ABSTRACT

A traffic control gate having a gate arm and a motor which is removably mountable to existing road structures so as to be portable. An inverted U-shaped bracket straddles the road structure in saddle fashion and is secured thereto. The bracket is preferably a three-piece hinged unit comprising a base and two hinged side plates. The side plates are adjustably positionable about hinges so as to fit the contours of various K-rail sections and other structures. In the event the road surface is the only available structure, the side plates may be removed and the gate mounted on a sturdy table by the base's hinges. The motor is preferably battery operated so that the gate is usable where no external power supply is available. Handles on the base allow the compact gate to be carried to another location.

20 Claims, 5 Drawing Figures

PORTABLE TRAFFIC CONTROL GATE

TECHNIAL FIELD

The present invention relates to traffic control gates for closing off and allowing the passage of vehicular traffic and in particular to a portable traffic control gate.

BACKGROUND ART

Traffic control gates are used to alternately block and allow traffic flow at entrances and exits of parking lots, parks and benches, military bases, and other facilities where control of admission to or past the facilities is desired. Many security systems use concrete median barriers, known as "K-rails" or "Jersey barriers", to narrow down the approach to a facility. A traffic control gate near the entrance to such a facility typically has an arm which is responsive to a suitable control, and which, after presentation of an identification card or payment of money, may be raised to allow passage of traffic.

Often it is desirable or required that installation be above grade or temporary. For example, a driveway may already have been constructed before installation of a gate. Special events may require installation of additional gates which are to be removed when the event is finished.

In U.S. Pat. No. 4,318,079 to Dickinson, a motorized traffic-way controller has a retractile tire barrier installed above grade and a signal barrier supported by a drive unit at one side of the traffic-way in the form of an arm. The tire barrier and signal barrier are coordinated to operate in unison by the drive unit so that the arm is lifted when the teeth in the tire barrier are retracted.

It is an object of the present invention to produce a traffic control gate which may be used for changing or temporary situations.

DISCLOSURE OF INVENTION

The above object has been met with a portable traffic control gate in which a gate arm is removably mounted to an existing road structure such as a concrete median barrier or K-rail sections. The gate arm is disposable in a horizontal closed position for closing passage of traffic on a roadway. A motor moves the gate arm into an open position by causing the arm to pivot vertically about a motor driven shaft, thereby allowing the passage of traffic. An inverted U-shaped bracket, supporting the gate arm and motor, straddles the K-rail or similar road structure in saddle fashion and is secured thereto. The bracket is preferably a three-piece hinged unit comprising a base and two downwardly depending side plates joined to the base by hinges. The side plates are adjustably positionable about the hinges, thereby enabling the bracket to fit the contour of K-rail sections of various dimensions.

In the event that concrete median barriers or similar structures are not available or not being used, and the only existing road structure is the road surface itself, the side plates may be removed from the hinges and the base removably mounted by the hinges to a sturdy table secured to the road surface. The motor is preferably operable by battery power for further portability. The battery and a battery charger connected to the battery are supported on the bracket base which has a pair of handles for easy portability. Alternatively, the motor may receive external power where available through one or more solenoids.

The traffic control gate is truly portable in that it may be mounted to a variety of K-rails or similar existing road structures with different contours. It may be mounted to a table attached to the road surface in the event such structures are unavailable, or on a vehicle, such as a pickup truck. Further, the gate is operable either by an external power source or by battery power. The gate is supported on a single base, is compact and relatively light weight so that it may be easily carried short distances or hauled from place to place.

BEST MODE FOR CARRYING OUT THE INVENTION

Figure 1:
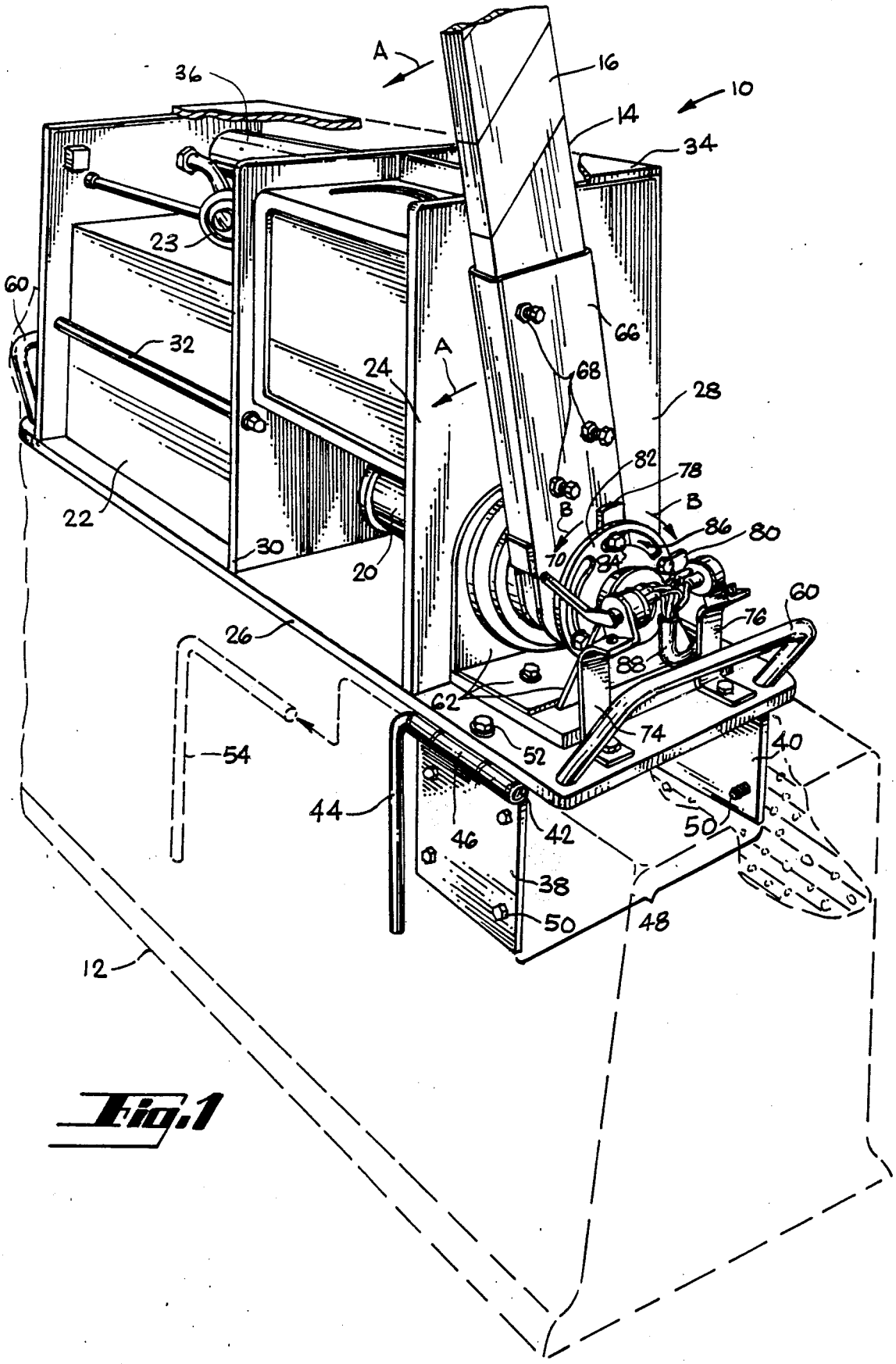
FIG. 1 is a perspective view of a portable traffic control gate in accord with the present invention.

With reference to FIG. 1, a portable traffic control gate 10 is removably mountable on an existing road structure 12, such as the concrete median barrier known as a "K-rail" or "Jersey barrier" and shown in phantom. Gate 10 has a gate arm 14 which swings in the direction shown by arrows A between the open position shown to a horizontal closed position. When gate arm 14 is in the open position, traffic is allowed to pass by gate 10, but when gate arm 14 is in the horizontal closed position, passage of traffic is closed. Gate arm 14 is preferably made of fiberglass, wood or other light material. Diagonal stripes 16 of reflective tape or paint may be provided on gate arm 14 to make the arm more visible. Preferably, gate arm 14 also has a red light, not shown, installed near the end of gate arm 14 to act as a visual stop signal. A breakaway wire, installed along the length of arm 14, may be used to signal backup security systems when arm 14 has been broken and gate 10 breeched by a driver attempting to gain forced entry to a facility.

Gate 10 has a motor 20 for moving gate arm 14. Motor 20 is preferably a 12-volt battery operable variable speed d.c. electric motor. A battery 22 connects to motor 20 to provide power. Battery 22 is recharged by a battery charger 24. A battery gauge 23 measures the available charge stored in battery 22 and indicates when battery 22 needs to be recharged. Power for battery charger 24 is provided, when available, by a 110 volt a.c. external line to solenoids which feed the battery charger. The external line connects to gate 10 at connections in the rear, discussed below with reference to FIG. 3. Motors adapted for use at other voltages may also be used, but 12-volt d.c. motors are preferred because of the widespread availability of 12-volt lead-sulfuric acid batteries and battery chargers for use with automobiles.

Motor 20, battery 22 and charger 24 are supported on a base 26 in a box 28. Box 28 is preferably divided into compartments by walls 30 and provided with guard rails 32 to prevent battery 22 and charger 24 from shifting and being damaged or damaging motor 20 and other components. Box 28 has a cover 34 to protect motor 20, battery 22, charger 24 and other electrical elements from water damage, wires leading from the 110 volt external connection are further protected by an electrically insulating plastic pipe or tube 36.

A pair of side plates 38 and 40 depend downwardly from base 26. Side plate 38 is joined to base 26 by a hinge 42. An L-shaped hinge pin 44 holds the loops 46 of hinge 42 together. The L-shape of pin 44 is not critical, but is preferred because the length of the L not in the loops 46 forms a handle which makes pin 44 particularly easy to remove. Plate 40 is similarly joined. Base 26 and side plates 38 and 40 together form a U-shaped bracket 48. Portable gate 10 may be removably mounted onto a road structure 12, such as a K-rail section, by bracket 48. Bracket 48 straddles road structure 12 in saddle fashion with base 26 resting on structure 12 and side plates 38 and 40 hanging down against the sides of structure 12. Side plates 38 and 40 are adjustably positionable about hinges 42 so as to fit the contour of structure 12. Bracket 48 is removably secured to structure 12 by bolts 50 in side plates 38 and 40. Base 26 may also be provided with bolts 52 to further secure gate 10.

Gate 10 may be removed from road structure 12 by unbolting bolts 50 and 52. Alternatively, side plates 38 and 40 may be detached from base 26 with bolts 52 and 50 unbolted. Pin 44 is removed from hinge 42 so that the loops on plate 38 are no longer connected to the loop 46 on base 26. Handles 60 on base 26 allow gate 10 to be carried to another location. Gate 10 may be reattached by reconnecting plates 38 and 40 to base 26 and securing them at hinges 42 with pins 44.

Figures 2, 3:
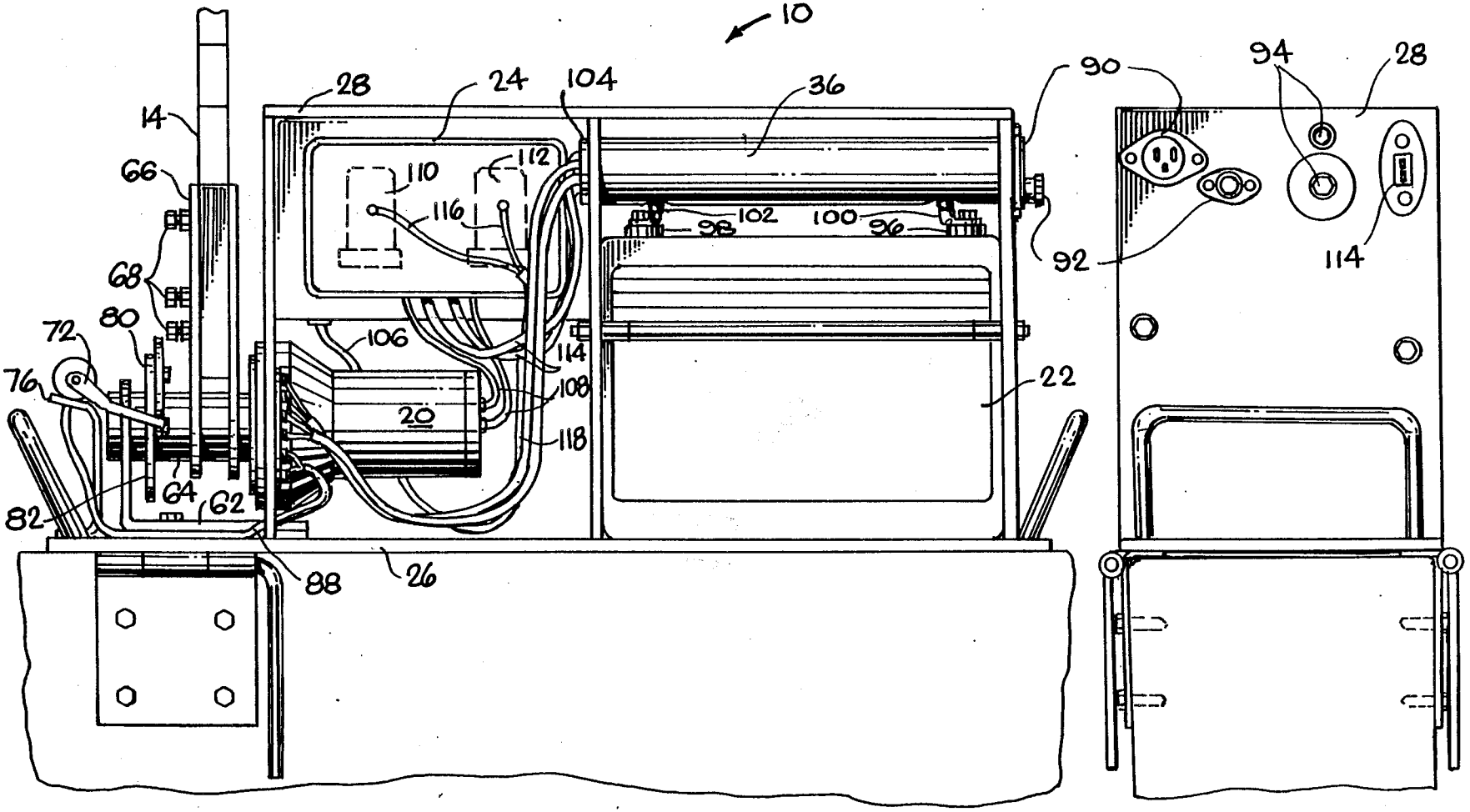
FIG. 2 is a side elevation of a portion of the gate of FIG. 1, mounted on a road structure.
FIG. 3 is a rear elevation of the same portion of the gate of FIG. 1 as shown in FIG. 2.

With reference to FIGS. 1 and 2, gate arm 14 pivots about a shaft 64 driven by motor 20. The gate moves between the open position shown and the horizontal closed position. Motor 20 is supported in box 28 above base 26 by an elbow bracket 62. The motor shaft 53 projects axially from motor 20 in a substantially horizontal direction. Elbow bracket 62 supports the motor shaft 64 as well as motor 20. Arm 14 is secured in a sleeve 66 by bolts 68. Arm 14 may be unbolted, removed from sleeve 66 and carried separate from the rest of gate 10 for more stable, compact and in general easier transportation. Sleeve 66 is secured at one end to shaft 64 so that arm 14 pivots on shaft 64 driven by motor 20.

Motor 20 is bidirectional, turning either clockwise or counterclockwise in the directions indicated by arrows B in FIG. 1. As a result, arm 14 may be both lowered in the direction indicated by arrows A to a horizontal closed position and raised in the opposite direction to the open position shown. Alternatively, arm 14 may be lowered in the direction opposite to arrows A, that is to the right in FIG. 1, and raised back to the open position shown.

A pair of limiter arms 70 and 72 signal to a motor control that arm 14 has reached the closed and open positions respectively. A bundle of wires 88 connects limiter arms 70 and 72 to motor 20. Limiter arms 70 and 72 are mounted on a pair of bracket members 74 and 76 respectively in the path of a pair of limiter actuating bars 78 and 80. Bracket members 74 and 76 are bolted or otherwise mounted on base 26. Bar 78 is secured to a disk 82 by a bolt 84 in a slot 86 of the disk. Bar 80 is similarly secured to disk 82. The placement of bars 78 and 80 on disk 82 is adjustable so as to adjust the closed and open positions of arm 14. Disk 82 is axially fixed on motor shaft 64, so that when motor shaft 63 turns and arm 14 pivots on shaft 64, disk 82 with bars 78 and 80 also turns in the same direction with arm 14.

As arm 14 turns in the direction indicated by arrows A between open and closed positions, disk 82 turns counterclockwise with arm 14. When arm 14 reaches the closed position, bar 78 pushes against limiter arm 70 causing an electrical signal to be generated and sent along bundle 88 to motor 20. Likewise, when arm 14 reaches the open position, bar 80 pushes against limiter arm 72 thereby sending a signal to motor 20. When motor 20 receives a signal from limiter arm 70 or 72, it shuts off, stopping arm 14 from moving past the open or closed position.

In FIGS. 2 and 3, motor 20 is supplied with power from battery 22. Battery 22 has battery terminals 96 and 98 to which wires 100 and 102 are connected, respectively. The external line connects to gate 10 at a plug 90. A control line output 92 connects to an external control line for receiving control signals. Control signals tell motor 20 when to turn on and off to raise and lower arm 14. Control signals may also act to switch power to motor 20 between battery 22 and the external line connected to plug 90. Wires 100 and 102 as well as wires connected to plug 90 and outlet 92 pass through tube 36 where they emerge at opening 104. Terminals 94 are positive and negative posts for attachment of jumper cables so that power may be supplied to the apparatus from a 12-volt automotive battery.

Battery charger 24 receives external power from a wire 106 for recharging battery 22. Wire 106 connects with plug 90. An indicator 114 works with gauge 23 in FIG. 1 to indicate when battery 22 needs recharging. Motor 20 receives power indirectly via wires 108 from a pair of solenoids 110 and 112 connected to battery 22 and external power via wires 114. Motor 20 is preferably a 12-volt d.c. variable speed motor. Solenoids 110 and 112 receive external power, typically at 11 volts a.c. and feed charger 24 which, in turn, supplies d.c. power. Solenoids 110 and 112 also receive control signals along wires 116, from an external control line via outlet 92 and wires 118 and from limiter wires 88. Solenoids 110 and 112 upon receiving control signals turn motor 20 on or off, or reduce the speed of motor 20, by adjusting the amount of power it delivers to motor 20 along wires 108.

Figures 4, 5:
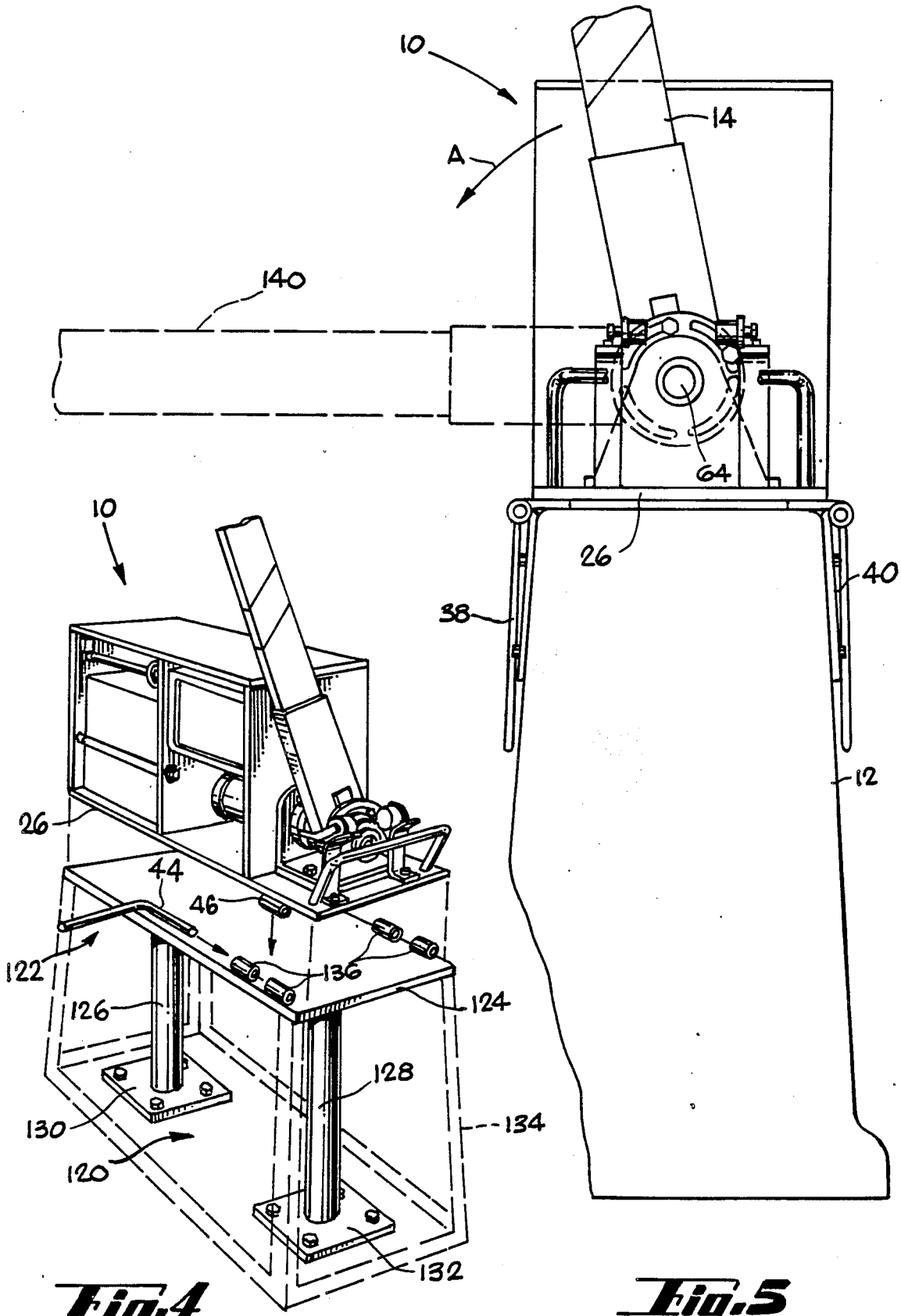
FIG. 4 is a perspective view of the gate of FIG. 1 mounted on a table secured to a road surface.
FIG. 5 is a front elevation showing operation of the gate of FIG. 1.

With reference to FIG. 4, gate 10 includes a table 122 mounted to a road surface 120. This embodiment is particularly useful when median barriers such as K-rail sections are absent and the only existing road structure is the road surface itself. Table 122 comprises a table top 124 resting securely on table legs 126 and 128. Although two legs 126 and 128 are shown, table 122 may have a single leg or more than two legs. Legs 126 and 128 are bolted to road surface 120 at bases 130 and 132 of legs 126 and 128 respectively. Legs 126 and 128 may be exposed, as shown, or surrounded by side walls 134.

Base 26 of gate 10 is removably mounted to table 122 by loops 46 and 136. Side plates 38 and 40 are detached from base 26, as described above with reference to FIG. 1, leaving hinge loops 46 on base 26. Base 26 is lowered onto table top 124 so that loops 46 align with loops 136 on table top 124. Hinge pins 44 are then inserted into loops 46 and 136, securing gate 10 to table 122. Gate 10 may be dismounted by removing hinge pins 44 from the hinges and lifting gate 10 off of table top 124.

In FIG. 5, a gate 10 is mounted on a K-rail section 12. The U-shaped bracket, comprising base 26 and two hinged depending side plates 38 and 40, straddles K-rail 12 in saddle fashion and is mounted thereto. In operation, a gate arm 14 pivots about motor shaft 64 in a direction indicated by arrow A from an open position to a substantially horizontal closed position shown by phantom gate arm 140. While the above description and the drawings show gate 10 straddling the top of median barriers 12, gate 10 is also capable of being mounted in other orientations. For example, it may be mounted to the side of a sturdy pole or end of a wall such that gate arm 14 pivots horizontally rather than vertically. This may be visualized by viewing FIG. 5 as a plan view with gate 10 mounted to a wall 12 and with the roadway parallel to the paper. The roadway may either run along wall 12, in which case gate arm 14 is in an open position and phantom gate arm 140 is in a closed position, or perpendicular to the wall 12, in which case gate arm 14 is in a closed position across the roadway and phantom gate arm 140 is in an open position. As already noted above, gate arm 14 may also be adjusted to pivot in a direction opposite to that shown in FIG. 5. The gate 10 of the present invention is a versatile portable gate, which may be carried to needed locations or even mounted to vehicles, such as to the tailgate of a pickup truck.

What is claimed is:

1. A portable traffic control gate comprising, a gate arm horizontally disposable for closing passage of traffic on a road, means for moving said gate arm into open and closed positions, allowing the control of traffic, and means for removably mounting said gate arm on an existing road structure, said means for removably mounting said gate arm including a base and a pair of side plates, said base having opposing side edges, each releasably attached to a side plate by a hinge-like joint, said base supporting said gate arm and said means for moving said gate arm.

2. The gate of claim 1 wherein said base and said plates combine to form a U-shaped bracket supporting said gate arm and straddling in saddle fashion said existing road structure, said bracket being removably secured to said road structure by a plurality of bolts.

3. The gate of claim 2 wherein said side plates are adjustably positionable about said hinge-like joints, said hinge-like joints each having a plurality of hinge loops and having an L-shaped pin removably passing through said loops.

4. The gate of claim 1 wherein said existing road structure is a concrete median traffic barrier.

5. The gate of claim 1 wherein said existing road structure is a road surface, said gate further comprising a table secured to said road surface, said means for mounting comprising a base supporting said gate arm and removably mounted to said table.

6. The gate of claim 1 wherein said means for moving said gate arm comprises a bidirectional electric motor, said gate arm being pivoted about said motor, said portable traffic control arm further comprising a pair of limiter switches and a means for actuating said limiter switches, said limiter switches electrically joined to said motor to deactivate said motor, said means for actuating the limiter switches being selectively positionable for contact with said limiter switches.

7. The gate of claim 6 wherein said motor is operable by a battery, said battery supported by said base.

8. The gate of claim 1 wherein said gate arm swings vertically about a pivot between a horizontal closed position and said open position.

9. A portable traffic control gate comprising, a base member having opposing side edges, a gate arm supported on said base member and horizontally disposable for closing passage of traffic, said gate arm having an open position and a closed, substantially horizontal position, a motor driven shaft, said gate arm pivotable about said shaft into an open position allowing the passage of traffic, bidirectional motor means for driving said shaft, first and second limiter switches electrically joined to said motor means to deactivate said motor means, said first limiter switch deactivating said motor means when said gate arm reaches an open position, said second limiter switch deactivating said motor means when said gate arm reaches a closed position, means for activation of said first and said second limiter switches, said means for activation being adjustably positionable relative to said limiter switches, and a pair of side plates removably attached to said opposing side edges of said base member, said side plates each mounted to said base member by a pivotable joint and removably secured to an existing road structure.

10. The gate of claim 9 wherein said side plates are joined to said base member by a plurality of intermeshing hinge loops and a connector pin passing therethrough, said opposing side edges of the base member each having at least one base hinge loop, said side plates each having at least one plate hinge loop for contact with a base hinge loop, said side plates being adjustably positionable about said hinge loops.

11. The gate of claim 9 wherein said existing road structure is a K-rail selection.

12. The gate of claim 9 wherein said motor is operable by a battery, said battery supported by said base member.

13. The gate of claim 9 wherein said gate arm pivots vertically about said motor means.

14. The gate of claim 12 wherein said base member supports a battery charger connectable to said battery.

15. The gate of claim 9 wherein said base member has a pair of handles.

16. The gate of claim 9 wherein said motor means receives electric power through at least one solenoid.

17. A portable traffic control gate comprising, a gate arm horizontally disposable for closing passage of traffic, said gate arm having an open position and a closed, substantially horizontal position, an electric motor and a battery capable of powering said motor, a shaft bidirectionally driven by said motor, said gate arm pivotable about said shaft into an open position allowing passage of traffic, a first limiter switch and a second limiter switch electrically joined to said motor to deactivate said motor, said first limiter switch deactivating said motor when said gate arm reaches an open position, said second limiter switch deactivating said motor when the gate arm reaches a closed position, said shaft having an adjustably positionable means for activating said first and second limiter switches, a base supporting said gate arm and said motor, said base having a pair of opposed side edges, each having at least one base hinge loop and a hinge pin, and two downwardly depending side plates joined to said base, each side plate having an edge having at least one plate hinge loop, said plate hinge loops removably attached to an associated base hinge loop by said connector pin passing therethrough, said base and two side plates forming a U-shaped bracket capable of straddling in saddle fashion a K-rail section, said side plates being adjustably positionable about said connector pin to fit the contour of said K-rail section and removably secured to said K-rail section.

18. The gate of claim 17 wherein said rotatable shaft includes a sleeve, said gate arm removably fit within said sleeve.

19. The gate of claim 17 wherein each connector pin is an L-shaped pin having a portion passing through said base hinge loops and said plate hinge loops.

20. The gate of claim 18 wherein said base has handles.

* * * * *